US005271566A

United States Patent [19]

Dederich

[11] Patent Number: 5,271,566

[45] Date of Patent: Dec. 21, 1993

[54] SELF-ORIENTING SPRAY NOZZLE SYSTEM

[75] Inventor: Paul L. Dederich, County of Lehigh, Pa.

[73] Assignee: D. B. Smith & Company, Inc., Utica, N.Y.

[21] Appl. No.: 964,351

[22] Filed: Oct. 21, 1992

[51] Int. Cl.[5] ..... B05B 1/02

[52] U.S. Cl. ..... 239/600; 239/602

[58] Field of Search ..... 239/597, 598, 599, 600, 239/601, 602, 590, 590.5, 499, 461

[56] References Cited

U.S. PATENT DOCUMENTS

| | | | |
|---|---|---|---|
| 2,018,819 | 10/1935 | Thompson | 299/140 |
| 2,298,934 | 10/1942 | Foster | 239/600 |
| 3,045,932 | 7/1962 | Steinen | 239/601 |
| 3,273,805 | 9/1966 | Hall | 239/590.3 |
| 3,767,123 | 10/1973 | Dreisin | 239/533 |
| 4,130,247 | 12/1978 | Healy | 239/523 |
| 4,365,758 | 12/1982 | Schaming | 239/590 |
| 4,588,131 | 5/1986 | Yamamoto et al. | 239/428 |
| 4,645,127 | 2/1987 | Emory et al. | 239/299 |
| 4,736,892 | 4/1988 | Calder | 239/592 |
| 4,824,017 | 4/1989 | Mansfield | 239/9 |
| 5,060,869 | 10/1991 | Bekius | 239/599 |
| 5,133,502 | 7/1992 | Bendig et al. | 239/599 |

*Primary Examiner*—Andres Kashnikow
*Assistant Examiner*—Lesley D. Morris
*Attorney, Agent, or Firm*—Lawrence P. Trapani

[57] ABSTRACT

A liquid sprayer apparatus of the type in which liquid is caused to flow from a liquid supply tank, through a spray conduit, to a spray nozzle assembly. The spray nozzle assembly comprises: an adapter mounted to the spray conduit; and a spray nozzle holder; and a spray nozzle configured to produce a flat fan spray pattern. The nozzle is received in the nozzle holder, and the holder is coupled to the adapter such that the nozzle adjoins the adapter in a secure assembly. A self orienting indexing system, associated with the adapter and the nozzle, orients the nozzle in either one of two orthogonal bearing positions relative to the adapter upon the coupling of the holder to the adapter. The self orienting system includes a plurality of indexing holes contained in the adapter and a plurality of matching indexing spurs projecting from the nozzle.

14 Claims, 2 Drawing Sheets

SELF-ORIENTING SPRAY NOZZLE SYSTEM

BACKGROUND OF THE INVENTION

1. Technical Field

The present invention relates generally to liquid sprayer apparatus and, more particularly, to liquid sprayer apparatus utilizing flat fan spray nozzles.

2. Background Art

In some conventional sprayer apparatus, one nozzle type may be interchangeable with another nozzle type. This interchangeable feature allows the operator to choose a nozzle that will produce a liquid spray pattern which best suits his or her present application. Typically, an inter-changeable nozzle is situated between a threaded nozzle holder and a threaded adapter or fitting associated with the spray wand of the sprayer apparatus. The holder is threaded to the wand adapter to secure the nozzle into place. If the nozzle is a flat fan nozzle, the orientation of the nozzle, as it is situated in the sprayer apparatus, becomes a principal consideration.

This patent application is primarily concerned with sprayer apparatus employing flat fan nozzles. Such nozzles provide a wide, fan-shaped, spray pattern in one general direction (e.g., horizontal or vertical). They are employed to precisely direct an even application of liquid over a wide area in one direction.

When a flat fan nozzle is assembled in a nozzle assembly, it must be manually adjusted to a desired orientation before the holder is tightened onto the adapter. Sometimes, the nozzle's orientation shifts, and the holder must be loosened to readjust the nozzle's orientation. This adjustment process tends to be tedious. More notably, this method can be harmful to the operator For instance, as the nozzle adjustment takes place, the operator's hands are in constant contact with the nozzle and any liquid issuing therefrom. If the liquid is toxic, the operator risks being poisoned by absorption through the skin or inadvertent ingestion. This potential hazard may be the most significant drawback of interchangeable flat fan sprayer apparatus.

Heretofore, those skilled in the art have held the general perception that an interchangeable nozzle assembly could not easily incorporate a system for orienting a flat fan nozzle without destroying the interchangeable character of the assembly. The present invention has overcome this hurdle.

SUMMARY OF THE INVENTION

It is therefore an object of the present invention to provide a liquid sprayer apparatus having a spray nozzle assembly that avoids the problems associated with the prior art.

It is another object of the present invention to provide a nozzle assembly which ensures that a spray pattern, produced by a flat fan nozzle, is oriented in either the horizontal or vertical plane relative to the operator.

It is a further object of the present invention to provide a nozzle assembly having an indexing system that orients a flat fan nozzle in either one of two orthogonal bearing positions to produce a horizontal or vertical spray pattern.

It is yet another object of the present invention to provide a nozzle assembly that allows an operator to orient and secure a flat fan nozzle in a desired bearing position with the use of one hand.

It is yet a further object of the present invention to provide a nozzle assembly that does not require adjustment of a flat fan nozzle during operation of the sprayer apparatus, and thus minimizes possible exposure of the operator to the liquid being sprayed.

It is still another object of the present invention to provide a nozzle assembly that can accommodate spray nozzles that are not especially adapted for the indexing system of the present invention.

These and other objects are attained in accordance with the present invention wherein there is provided a liquid sprayer apparatus of the type in which liquid is caused to flow from a liquid supply tank, through a spray conduit, to a spray nozzle assembly. The spray nozzle assembly comprises: an adapter mounted to the spray conduit; a spray nozzle holder; and a spray nozzle configured to produce a flat fan spray pattern. The nozzle is received in the nozzle holder, and the holder is coupled to the adapter such that the nozzle adjoins the adapter in a secure assembly. A self orienting means, associated with the adapter and the nozzle, orients the nozzle in either one of two orthogonal bearing positions upon the coupling of the holder to the adapter.

The adapter contains a bore communicating with the spray conduit at a first end and terminating at an opening in a second end or end face. The nozzle includes a flange portion and a barrel portion. The flange portion and the end face of the adapter are adjoined when the nozzle system is assembled. The nozzle contains a passageway that originates at an opening in the flange portion and terminates at an orifice in the barrel portion.

In the preferred embodiment, the self orienting means includes a plurality of indexing holes contained in the end face of the adapter. The indexing holes are disposed radially from the end face opening, along respective radial axes which are spaced apart at ninety (90) degree angles. The self orienting means also includes at least one indexing spur, configured and dimensioned to mate with at least two of the indexing holes. The indexing spur projects from the flange portion of the nozzle and is disposed radially from the flange opening along a radial axis. Preferably, there is a plurality of indexing spurs projecting from the flange, and each spur is configured and dimensioned to mate with a respective indexing hole contained in the adapter. As shown in the figures, four indexing holes and four corresponding indexing spurs are employed in the preferred embodiment.

The position of each indexing spur, along its respective radial axis, corresponds to the radial axis positions of at least two adjacent indexing holes. With this arrangement, the nozzle can be positioned in either one of two orthogonal bearing positions upon the coupling of the holder to the adapter.

BRIEF DESCRIPTION OF THE DRAWING

Further objects of the present invention will become apparent from the following description of the preferred embodiments with reference to the accompanying drawings, in which.

DESCRIPTION OF THE PREFERRED EMBODIMENT

Figure 1:
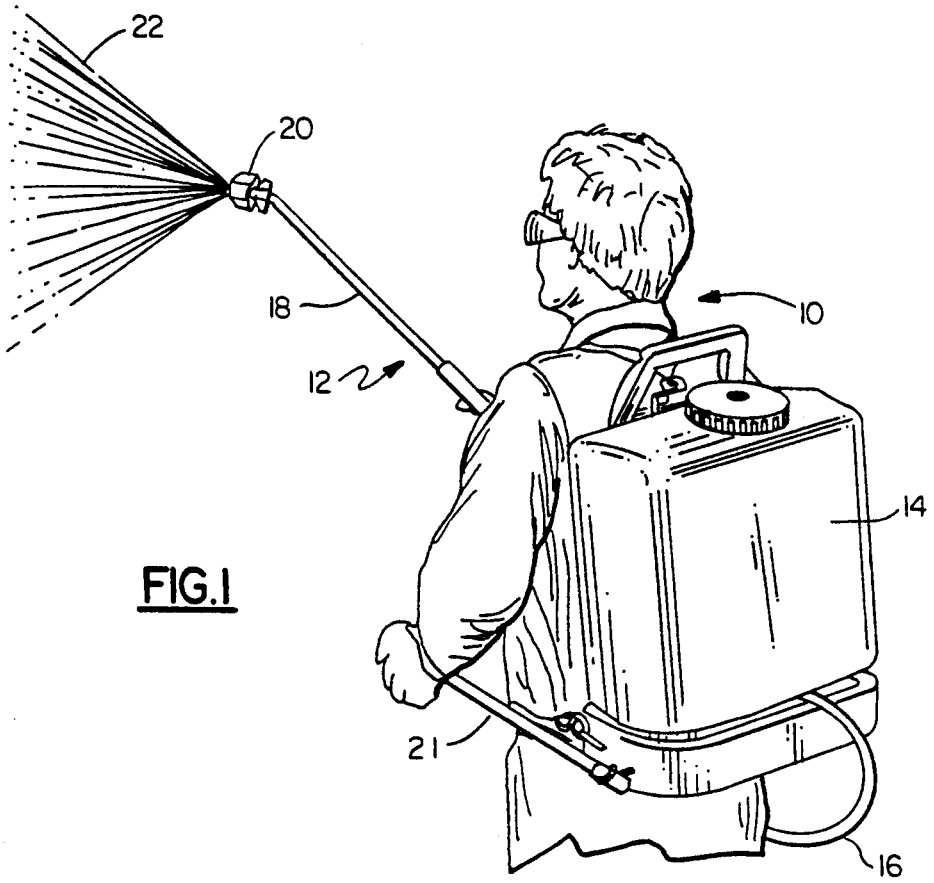
FIG. 1 is a perspective view showing an individual operating a sprayer apparatus which contains a nozzle assembly embodying the teachings of the present invention.

Referring to FIG. 1 of the drawings, there is shown an operator 10 operating a sprayer apparatus 12 in a usual manner. Sprayer apparatus 12 includes a polyethylene supply tank 14 which is strapped to the back of operator 10. Tank 14 may contain a liquid, such as a pesticide, herbicide, fertilizer, or water. The liquid is supplied from tank 14 through a spray conduit comprising a reinforced polyvinyl chloride (PVC) supply hose 16, a spray trigger (not shown), and a poly-propylene spray wand 18. At the distal end of wand 18, there is connected a nozzle assembly 20 constructed in accordance with the present invention. A pump handle 21 is worked by the operator to pump liquid from tank 14 to nozzle assembly 20.

As liquid is passed through nozzle assembly 20, it is discharged in a predetermined spray pattern depending upon the configuration of the nozzle used. As shown in FIG. 1, a flat fan spray pattern 22, positioned in a vertical operating orientation, is produced by an appropriate nozzle contained in assembly 20. Alternatively, spray pattern 22 could be positioned in a horizontal operating orientation depending upon the bearing position of the nozzle in assembly 20.

Figure 2:
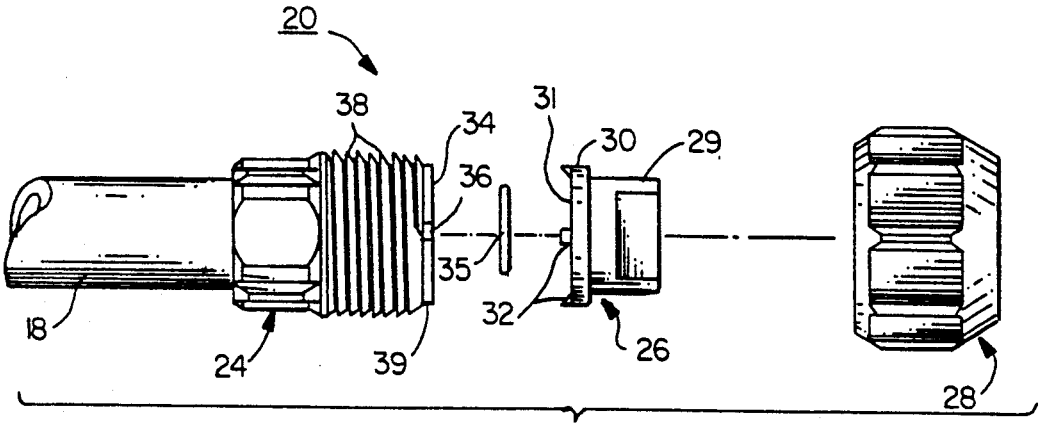
FIG. 2 is an exploded view of the nozzle assembly of the present invention, including a threaded adapter, a flat fan spray nozzle, and a threaded nozzle holder.

Referring now to FIG. 2, there is shown an exploded view of nozzle assembly 20. Assembly 20 comprises a male wand adapter 24 fixedly mounted to spray wand 18, a flat fan nozzle 26, and a nozzle holder 28. Like wand 18, adapter 24, nozzle 26 and holder 28 are all made of polypropylene. Nozzle 26 comprises a barrel 29 and an engagement flange 30, and is configured and dimension to be received in holder 28 upon assembly. Flange 30 has a rear face 31 from which four indexing spurs 32 project. Spurs 32 are equally spaced about the perimeter of flange 30. Their arrangement will be further described below with reference to FIG. 7.

Adapter 24 has an end face 34 containing four indexing notches or holes 36 (See FIGS. 2 and 14) equally spaced about the perimeter of end face 34. The positions, configurations and dimensions of spurs 32 correspond with those of holes 36 such that spurs 32 will mate with holes 36 when nozzle 26 and adapter 24 are brought together in assembly. Upon engagement of spurs 32 with notches 36, rear face 31 adjoins end face 34.

With further reference to FIG. 2, an o-ring 35, made of Buna-N ®, is inserted between nozzle 26 and adapter 24. When nozzle assembly 20 is assembled, o-ring 35 is seated in an annular groove (See FIGS. 13 and 14) contained in end face 34. O-ring 35 ensures a liquid tight seal between adapter 24 and nozzle 26 when nozzle system 20 is assembled.

As shown in FIG. 2, adapter 24 contains an external thread 38 formed around a coupling portion 39. Thread 38 is configured and dimensioned for a tight threaded engagement with an internal thread 40 (See FIG. 6) contained in holder 28. Threads 38 and 40 are complementary "buttress" threads, having a density of 20 threads per inch. Buttress threads 38 and 40 facilitate the manual coupling of holder 28 to adapter 24, and provide greater strength than standard threads against over torquing.

Figure 3:
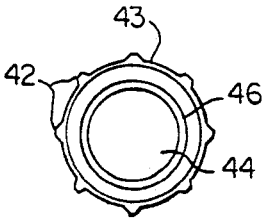
FIGS. 3-6 show the nozzle holder in bottom plan, side elevation, top plan, and cross sectional views respectively.
Figure 4:
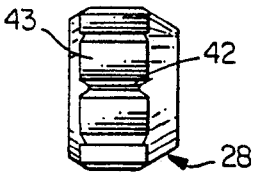
Figure 5:
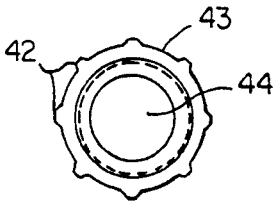
Figure 6:
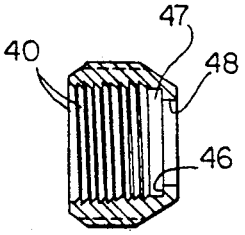

With reference to FIGS. 3-6, the construction of nozzle holder 28 can be described. Holder 28 has eight grippers 42 equally spaced about an external perimeter surface 43. As shown in FIGS. 3 and 6, an axial passageway 44 runs through holder 28. Passageway 44 includes a coupling portion containing buttress thread 40. At the nose end of holder 28, contained inside holder 28, is a circular shoulder or rim 46 (See FIGS. 3 and 6). The interior walls of shoulder 46 and holder 28, together, define a flange pocket 47 (See FIG. 6). Passageway 44 is configured and dimensioned to allow nozzle 26 to be inserted and seated in pocket 47 upon assembly. Shoulder 46 also defines a bore 48 which is dimensioned to allow barrel 29 of nozzle 26 to extend therethrough and project out beyond holder 28. As shown in the cross-sectional view of FIG. 6, buttress thread 40 is substantially coextensive with passageway 44, except for pocket 47 and bore 48.

Figure 7:
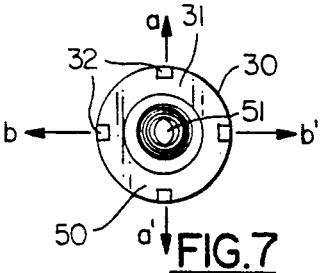
FIGS. 7-9 show the flat fan spray nozzle in bottom plan, side elevation and top plan views respectively.
Figure 8:
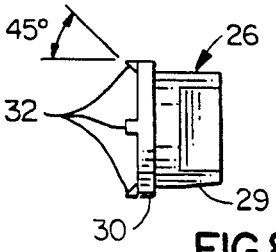
Figure 9:
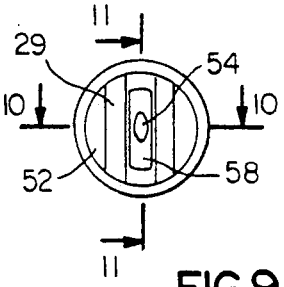
Figure 10:
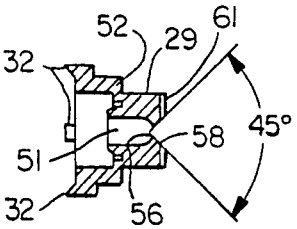
FIGS. 10 and 11 show cross sectional views of the flat fan spray nozzle along lines 10—10 and 11—11 respectively of FIG. 9.

Referring now to FIGS. 7-11, the construction of flat fan nozzle 26 can be described. In the bottom plan view of FIG. 7, it is shown that rear face 31 has a surface 50. As shown in FIGS. 7 and 10, nozzle 26 contains a passageway 51 that originates at an opening contained in rear face 31 and terminates at an orifice in barrel 29. As shown in FIGS. 8, spurs 32 project out from end face 31, and terminate at respective distal ends. As shown, spurs 32 are each shaped in the form of a wedge, and each has a 45 degree taper which terminates in an edge at the distal end of the spur. The tapered edges of spurs 32 minimize the frictional drag, and facilitate engagement with holes 36, as nozzle 26 is rotated against adapter 24. As shown in FIG. 7, indexing spurs 32 are disposed radially from the opening in flange 30, along radial axes a—a' and b—b'. One pair of spurs 32 are spaced apart in a diametrically apposed relation along axis a—a', and the other pair of spurs 32 are similarly arranged along axis b-b'. As clearly shown in FIG. 7, axes a—a' and b—b' are orthogonal (i.e., spaced apart by a ninety degree angle). In the preferred embodiment, spurs 32 are positioned adjacent to the perimeter of flange 30, as shown. The positions of spurs 32, along their respective radial axes, are made to correspond to the positions of indexing holes 36, along their respective radial axes.

As shown in the top plan view of FIG. 9, barrel 29 contains a shoulder 52 (see also FIG. 10). Shoulder 52 is formed as a result of a design decision to reduce the material requirements for barrel 29. The resulting oblong shape of barrel 29 provides an indication of the orientation of nozzle 26 in assembly 20.

In FIG. 9, nozzle 26 is shown containing an elliptical spray orifice 54. As shown in FIG. 10, passageway 51 terminates at a spherically shaped orifice chamber 56. Orifice 54 is formed by the intersection of chamber 56 with a V-shaped slot 58. In the preferred embodiment, V-shaped slot 58 has a 45 degree V-shaped profile (See FIG. 10). The combined arrangement of orifice 54 and slot 58 produces a flat fan spray pattern of 80 degrees.

Figure 11:
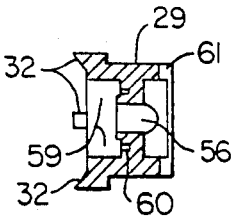

The cross-sectional views of FIGS. 10 and 11 are taken along lines 10—10 and 11—11 respectively of FIG. 9. As shown in FIGS. 10 and 11, nozzle 26 contains a cylindrical cavity 59 at the opening in flange 30.

An annular groove 60, which is concentric with chamber 56, is contained in barrel 29. As shown in FIGS. 10 and 11, groove 60 has its opening facing cavity 59. Cavity 59 and groove 60 function together to reduce turbulence, and thus air bubbles, in the liquid as it is pumped through nozzle 26. With further reference to FIGS. 10 and 11, there is shown a shroud 61 formed at the extreme tip of nozzle 26. Shroud 61 functions to provide protection against deformation of orifice 54 and slot 58.

Figure 12:
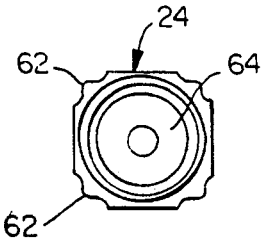
FIGS. 12-14 show the threaded adapter in bottom plan, cross sectional, and top plan views respectively.
Figure 13:
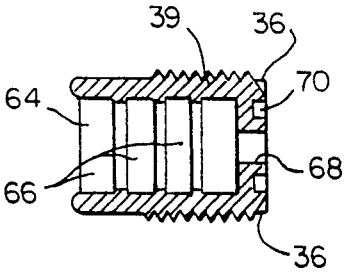
Figure 14:
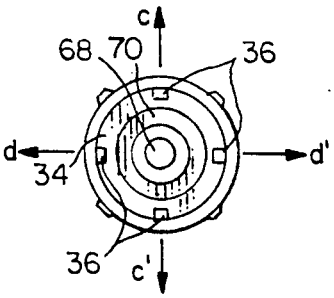

Referring now to FIGS. 12-14, further detail of adapter 24 is shown. In the bottom plan view of FIG. 12, adapter 24 is shown containing four grippers 62 and a mating bore 64. Projecting from the inside wall of bore 64 are three mounting ribs 66, as shown in FIG. 13. An exhaust bore 68 passes through end face 34, as shown in FIGS. 13. An annular cavity 70 is contained in end face 34, and is concentric with bore 68, as shown in FIG. 14. Cavity 70 is configured and dimensioned to closely receive o-ring 35.

As shown in FIG. 14, holes 36 are disposed radially from bore 68 along radial axes c—c' and d—d'. One pair of holes 36 are spaced apart in a diametrically apposed relation along axis c—c', and the other pair of holes 36 are similarly arranged along axis d—d'. As clearly shown in FIG. 14, axes c—c' and d—d' are orthogonal. In the preferred embodiment, holes 36 are positioned adjacent to the perimeter of end face 34, as shown. The positions of holes 36, along their respective radial axes, are made to correspond to the positions of indexing spurs 32, along their respective radial axes.

In the manufacture of sprayer 12, wand 18 is inserted into bore 64 of adapter 24, and adapter 24 is spun welded to wand 18. The position of adapter 24, relative to wand 18, is determined so that notches or holes 36 in end face 34 will be arranged in the horizontal and vertical planes when wand 18 is operated in the normally intended manner. (e.g., See FIG. 1).

In operation, nozzle 26 is inserted into holder 28. Barrel 29 of nozzle 26 slides through holder bore 48 until flange 30 is seated in pocket 47, against shoulder 46. O-ring 35 is seated in annular channel 70. The combined assembly of nozzle 26 and holder 28 is brought to coupling portion 39 of adapter 24. Holder 28 is then threaded onto coupling portion 39. The rotation of holder 28, during the threading operation, causes nozzle 26 to rotate. As nozzle 26 is rotated, the edges of indexing spurs 32 are in sliding engagement with end face 34 of adapter 24. After a quarter turn of nozzle 26, spurs 32 should engage and seat into corresponding indexing holes 36. Holder 28 is threaded onto coupling portion 39 until a tight engagement is achieved between threads 38 and corresponding threads 40. At this point, nozzle system 20 is fully assembled, and nozzle 26 oriented in either one of two orthogonal bearing positions relative to adapter 24. In one bearing position, the spray pattern produced by nozzle 26 will be in a vertical direction (assuming normal positioning of wand 18). A spray pattern in the horizontal direction will be produced from the other, orthogonal, bearing position.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims. For example, the self-orienting means may be configured in reverse, with indexing spurs 32 located on end face 34 of adapter 24 and indexing holes contained in end face 31 of nozzle 26.

I claim:

1. A liquid sprayer apparatus of the type in which liquid is caused to flow from a liquid supply tank, through a spray conduit, to a spray nozzle assembly, wherein said spray nozzle assembly comprises:

an adapter mounted to the spray conduit;

a spray nozzle holder;

a spray nozzle, configured to produce a flat fan spray pattern, said nozzle being received in said nozzle holder, said holder being coupled to said adapter such that said nozzle adjoins said adapter in a secure assembly; and self orienting means, associated with said adapter and said nozzle, for orienting said nozzle in either one of two orthogonal bearing positions relative to said adapter upon the coupling of said holder to said adapter.

2. A liquid sprayer apparatus as recited in claim 1, wherein said self orienting means includes first means, associated with said adapter, for mating with a complementary mating means, and second means, associated with said spray nozzle and complementary to said first mating means, for mating with said first mating means, whereby said first and said second mating means engage each other upon the coupling of said holder to said adapter and cause said nozzle to orient itself into either one of two orthogonal bearing positions.

3. A liquid sprayer apparatus as recited in claim 2, wherein said adapter contains a bore communicating with said spray conduit at a first end and terminating at an opening in a second end, and wherein the first mating means of said self orienting means includes a plurality of indexing holes contained in the second end of said adapter, the holes being disposed radially from the second end opening along respective radial axes which are spaced apart at ninety (90) degree angles;

wherein said nozzle includes a flange portion and a barrel portion, the flange portion and the second end of said adapter being adjoined when said nozzle assembly is assembled, said nozzle containing a passageway that originates at an opening in the flange portion and terminates at an orifice in the barrel portion; and wherein the second mating means of said self orienting means includes a plurality of indexing spurs projecting from the flange portion of said nozzle and disposed radially from the flange opening along respective radial axes, the position of each indexing spur along its respective radial axis being made to correspond to the radial axis positions of at least two adjacent indexing holes of said plurality of indexing holes.

4. A liquid sprayer apparatus as recited in claim 3, wherein the number of said indexing holes is four, and wherein the number of said indexing spurs is four.

5. A liquid sprayer apparatus as recited in claim 4, wherein said adapter includes a threaded coupling portion and said holder includes a threaded coupling portion, the threaded coupling portion of said holder being complementary to said coupling portion of said adapter such that the coupling of said holder to said adapter is accomplished by threading the coupling portion of said adapter with the coupling portion of said holder.

6. A liquid sprayer apparatus as recited in claim 5, wherein the threads of said coupling portions of said adapter and said holder are complementary buttress threads.

7. A liquid sprayer apparatus as recited in claim 4, wherein the second end of said adapter contains an annular cavity which is concentric with the second end opening; and wherein said nozzle assembly further comprises an o-ring closely received in said annular cavity.

8. A liquid sprayer apparatus as recited in claim 4, wherein the passageway in said spray nozzle includes a substantially cylindrical cavity at the opening in the flange portion of said nozzle and an orifice chamber contained in the barrel portion of said nozzle; and wherein said nozzle contains an annular groove which is concentric with said orifice chamber and opens to the cylindrical cavity.

9. A liquid sprayer apparatus as recited in claim 4, wherein each of said indexing spurs terminate at a respective distal end, and wherein each of said indexing spurs are tapered to a respective edge at the distal end.

10. A liquid sprayer apparatus as recited in claim 2, wherein said adapter contains a bore communicating with said spray conduit at a first end and terminating at an opening in a second end, and wherein the first mating means of said self orienting means includes a plurality of indexing holes contained in the second end of said adapter, the holes being disposed radially from the second end opening along respective radial axes which are spaced apart at ninety (90) degree angles;

wherein said nozzle includes a flange portion and a barrel portion, the flange portion and the second end of said adapter being adjoined when said nozzle assembly is assembled, said nozzle containing a passageway that originates at an opening in the flange portion; and terminates at an orifice in the barrel portion and wherein the second mating means of said self orienting means includes an indexing spur projecting from the flange portion of said nozzle and disposed radially from the flange opening along a radial axis, the position of the indexing spur along its radially axis being made to correspond to the radial axis positions of at least two adjacent indexing holes of said plurality of indexing holes.

11. A liquid sprayer apparatus as recited in claim 10, wherein the number of said indexing holes is four.

12. A spray nozzle being configured to produce a flat fan spray pattern, comprising a flange portion with an end face, and a barrel portion, and containing a passageway that originates at an opening in the end face of said flange portion and terminates at an orifice in said barrel portion, said flange portion having first and second indexing spurs projecting out from the end face and terminating at respective distal ends, said first and said second indexing spurs being disposed radially from the opening in the end face along respective first and second radial axes, the axes being spaced apart by a ninety degree angle.

13. A spray nozzle as recited in claim 12, wherein said flange portion further comprises third and fourth indexing spurs projecting out from the end face and terminating at respective distal ends, said third and said fourth indexing spurs being disposed radially from the opening in the end face, said third indexing spur being disposed along the first radial axis in diametrically opposed relation with said first indexing spur, said fourth indexing spur being disposed along the second radial axis in diametrically apposed relation with said second indexing spur.

14. A spray nozzle as recited in claim 13, wherein said indexing spurs are each tapered to an edge at their respective distal ends.

* * * * *